US007150138B2

(12) United States Patent
Powell et al.

(10) Patent No.: US 7,150,138 B2
(45) **Date of Patent: *Dec. 19, 2006**

(54) METHOD FOR FILLING A CONTAINER HAVING AT LEAST ONE FLEXIBLE COMPONENT

(75) Inventors: Kenneth G. Powell, Raleigh, NC (US); Carl Sahi, Coventry, CT (US); Charles Shermer, Raleigh, NC (US); John Polidoro, Coventry, CT (US); Chad C. Smutney, Stafford Springs, CT (US)

(73) Assignee: Becton, Dickinson and Company, Franklin Lakes, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/359,351

(22) Filed: Feb. 22, 2006

(65) Prior Publication Data

US 2006/0137297 A1 Jun. 29, 2006

Related U.S. Application Data

(63) Continuation of application No. 10/679,271, filed on Oct. 7, 2003, now Pat. No. 7,024,836.

(60) Provisional application No. 60/416,277, filed on Oct. 7, 2002.

(51) Int. Cl.
*B65B 3/04* (2006.01)
*B65B 31/02* (2006.01)

(52) U.S. Cl. ..... 53/469; 53/434; 53/86

(58) Field of Classification Search ..... 53/403, 53/432, 434, 468, 469, 471, 486, 559, 526, 53/574, 281, 86; 141/114

See application file for complete search history.

(56) References Cited

U.S. PATENT DOCUMENTS

| | | | | |
|---|---|---|---|---|
| 4,856,261 | A * | 8/1989 | Hackett et al. | 53/469 |
| 4,964,261 | A * | 10/1990 | Benn | 53/469 |
| 4,999,978 | A * | 3/1991 | Kohlbach et al. | 53/512 |
| 5,205,109 | A * | 4/1993 | Conway | 53/403 |
| 5,873,764 | A * | 2/1999 | Scherr | 446/220 |
| 6,168,413 | B1 * | 1/2001 | Weiler et al. | 425/524 |
| 6,464,486 | B1 * | 10/2002 | Barray et al. | 425/535 |
| 6,742,320 | B1 * | 6/2004 | Rapparini | 53/510 |
| 6,877,533 | B1 * | 4/2005 | Roskam | 141/114 |
| 7,024,836 | B1 * | 4/2006 | Powell et al. | 53/469 |

* cited by examiner

*Primary Examiner*—Stephen F. Gerrity
*Assistant Examiner*—Paul Durand
(74) *Attorney, Agent, or Firm*—Robert E. West

(57) ABSTRACT

Methods for filling and sealing containers having one or more flexible sides. Non-standard containers for holding fluid are releasably supported during the filling and sealing process. Both the interior and exterior of the filled container are subjected to an environment of reduced pressure to minimize the headspace and sealed.

19 Claims, 9 Drawing Sheets

METHOD FOR FILLING A CONTAINER HAVING AT LEAST ONE FLEXIBLE COMPONENT

RELATED APPLICATIONS

This Application is a continuation of U.S. patent application Ser. No. 10/679,271, filed on Oct. 7, 2003, now U.S. Pat. No. 7,024,836, which claims priority to U.S. Provisional Patent Application No. 60/416,277, filed Oct. 7, 2002, which is hereby incorporated by reference in its entirety.

FIELD OF THE INVENTION

This invention relates to methods for filling and sealing fluid containing containers, more particular to methods for filling and sealing a container in which one or more sides of the container are flexible.

BACKGROUND OF THE INVENTION

Standard containers are generally rigid and allow the container to stand upright or prevent it from collapsing in on itself, thereby reducing the container's interior fluid holding volume. This feature also allows the standard container to be placed on a conveying surface during the filling process without the necessity for externally supporting the container or its sides. Such standard containers include, but are not limited to glass cartridges and syringes.

Non-standard containers, such as IV bags or the reservoirs for devices such as a microinfuser, possess at least one flexible component. The flexible component of these non-standard containers creates several problems when trying to fill the container with liquids on an automated fluid filling line using existing fill head technology.

First, the flexible component has the potential to cling to other components of the container or to slump, and thereby interfere with the filling process. This can be especially troublesome where the fluid contains substances, such as proteins, which can be degraded by shearing forces during the filling process. Second, the container must be supported during the fluid filling and sealing process to allow it to be positioned properly with relation to the filling and sealing equipment. Furthermore, the headspace inside these, as well as standard containers, needs to be eliminated or at least minimized for many reasons, such as for improved stability and shelf-life, but standard container filling and sealing equipment cannot manage such non-standard containers.

SUMMARY OF THE INVENTION

The present invention is directed to methods for filling containers adapted to contain one or more fluids where the container comprises at least one fluid receiving opening, at least one flexible component having at least one external surface and at least one internal surface, a relaxed state interior volume and a non-relaxed state interior volume where the non-relaxed state volume is equal to or greater than the relaxed state volume.

Initially the container is releasably retained and placed in a position to receive a fluid to be dispensed therein. If necessary, the interior volume of the container in its relaxed state is opened or otherwise expanded to its non-relaxed state interior volume. This expansion may be performed separately from, or essentially simultaneously with, the dispensing of a fluid into the interior volume of the container. The headspace within the interior of the container is then eliminated or minimized. The minimization of the headspace may be accomplished by utilizing at least two methods. These methods may be performed separately, essentially simultaneously or, one method may be utilized to the exclusion of the other.

In preferred methods both the exterior of the at least one flexible component and the interior, fluid containing volume of said fluid containing container are subjected to an environment having a pressure of less than the ambient atmosphere prior to sealing the at least one fluid receiving opening. Once the environment of reduced pressure reaches a predetermined level the container is sealed and the environment is then increased to ambient pressure before, or essentially simultaneously with the release of the container.

An alternate embodiment comprises the manipulation of the fluid meniscus formed within the interior volume of the container to increase or reduce the headspace to a predetermined range prior to the sealing and release of the container. The fluid meniscus may or may not be manipulated while the container and interior volume are being subjected to the reduced pressure environment of the preferred embodiment.

Generally, the requirements of the fluid contained within the container after filling will determine which methods of minimizing the headspace will be utilized

DETAILED DESCRIPTION OF THE PREFERRED EMBODIMENTS

Figure 1:
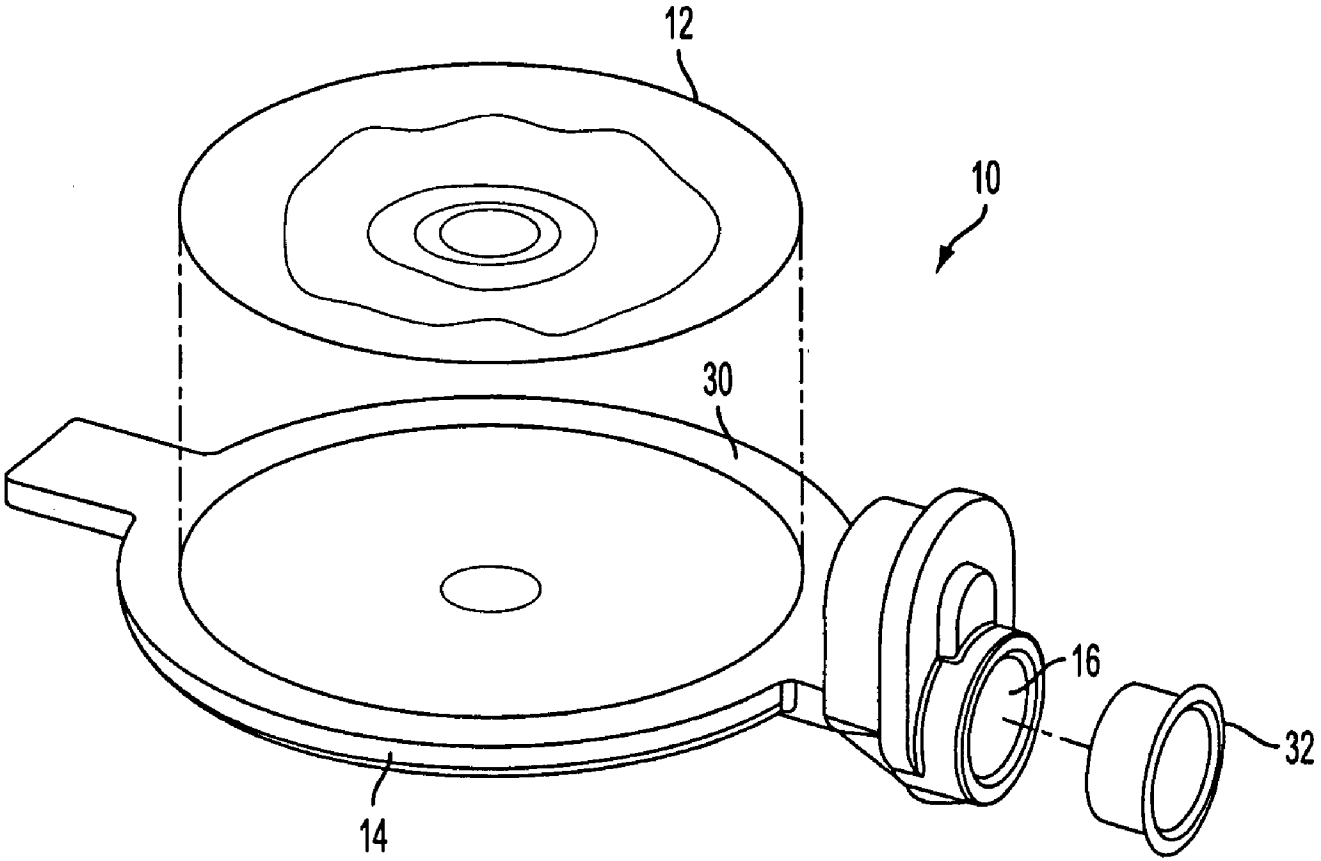
FIG. 1 is an exploded view of a microinfuser reservoir.
Figure 2:
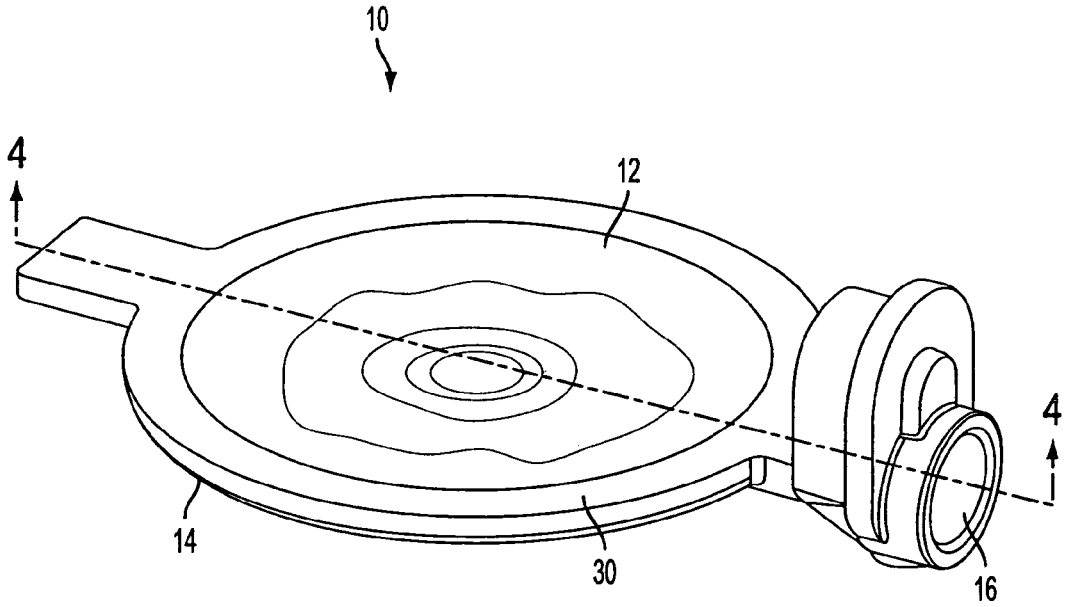
FIG. 2 is a side, edge on view of the reservoir of FIG. 1 in an empty, relaxed condition.

As will be appreciated by one skilled in the art, there are numerous device designs and variations of devices that can be used in performing the methods disclosed herein. Although reference will be made to embodiments depicted in the drawings and the following descriptions, the embodiments disclosed herein are not meant to be exhaustive of the various alternative designs and embodiments that can be encompassed by the herein disclosed invention. For example, in the following description reference will be made to a container in the form of a fluid reservoir utilized in an infuser. This reference is for convenience only and is not meant to restrict the type of container usable in the present inventive methods in any manner.

Filling lines traditionally handle cylindrical or rectangular containers that have rigid sides and bottoms which are, therefore, relatively easy to orient and fill. Non-standard containers, those having one or more components (such as a side or bottom wall) that are flexible, are not so easily handled during the fluid filling process. Because of the flexible nature of the at least one component in these non-standard containers, the flexible component has a tendency to sag, or slump, and can easily reduce the internal volume of the container, hereinafter "relaxed state interior volume". Such non-standard containers are not only difficult to handle, as they generally will not stand in a filling position unaided, but the slumping of the flexible component(s) can interfere will the fluid filling process in numerous ways.

As used herein, flexible component, means a component of a container, generally a container sidewall, that is unable to maintain, unaided, a vertical or horizontal position without, sagging, slumping or otherwise collapsing, or partially collapsing, under its own weight, or the weight of the container's contents. A flexible component may or may not have physical properties that allow it to expand or stretch. A flexible component may also comprise one or more layers of materials and the materials may be dissimilar or not.

FIG. 1 is an exploded view of a container 10 that is utilized as a biologically active agent reservoir to be housed in an infuser, not shown. The reservoir 10 has a flexible film component 12 covering and sealingly adhered to rigid component 14 along rigid component edge surface 30 for retaining a fluid, such as a liquid biologically active agent or pharmaceutical agent, therein. It is envisioned that a saline solution, or other fluid compositions may also be used. The fluid, not shown, is dispensed into the interior volume 18, FIG. 5, through fluid receiving opening 16. In the preferred embodiment shown in FIGS. 4 and 5, a hollow conical, funnel-like structure 20 is located within the fluid receiving opening 16. Since it is preferable to fill the reservoir under aseptic conditions when the fluid contained in container 10 is not able to be later sterilized, for example insulin, the conical structure 20 can help guide a dispensing nozzle 22, see FIG. 9, to aid in dispensing of the fluid into the interior volume 18, thereby easing the necessity of precisely aligning the opening and the dispensing nozzle. Conical structure 20 may be integrally molded or formed in the rigid component 14, or it may be a separate component and inserted into the fluid receiving opening 16 prior to the dispersing of the fluid.

In a standard filing line design a filling head with local reservoir evacuation is used. Filling lines traditionally handle cylindrical containers that are easier to orient and are more amenable to filling. The ability to positively locate the individual containers, particularly if they are irregularly shaped, simplifies handling and increases productivity through elimination of capital cost and waste from orientation equipment along the manufacturing line. Such actions are made more difficult or impossible when the standard filling line has to handle non-standard containers. Further complicating this is when the non-standard containers must be filled and sealed under aseptic conditions. Here, precise orientation of the container in relation to the filling equipment is important as misalignment can result in wetting of the neck of the container opening.

Figure 6:
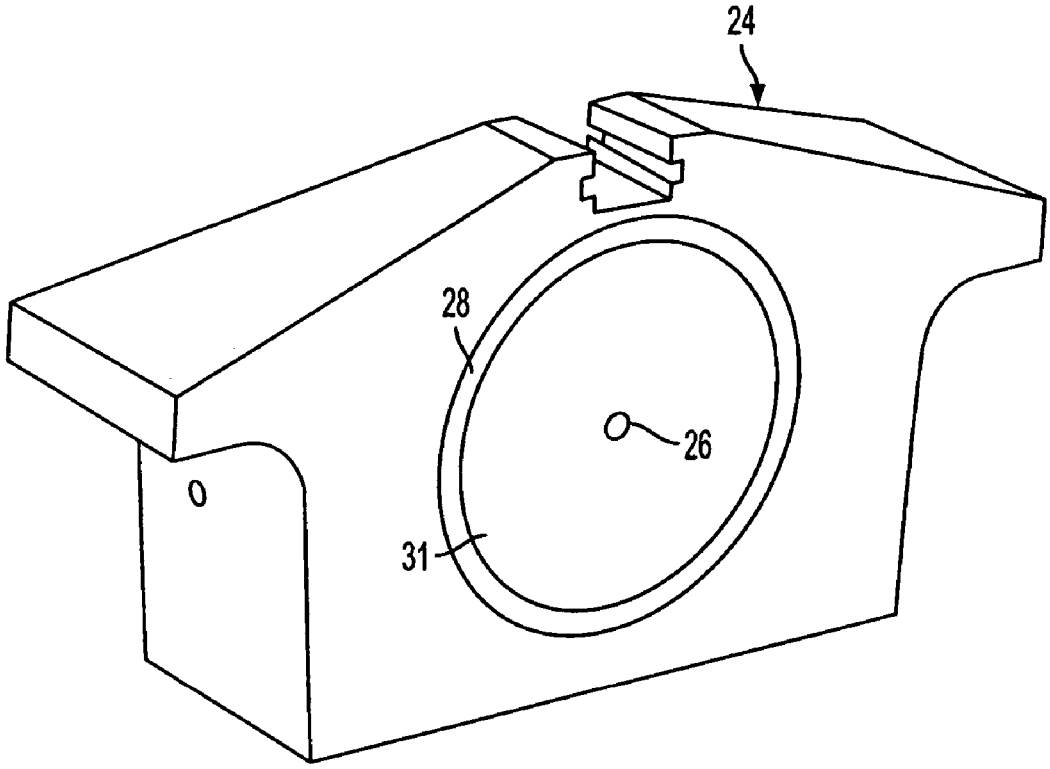
FIG. 6 is an elevated perspective vie of a preferred embodiment of a retaining device for retaining the reservoir of FIG. 1.
Figure 7:
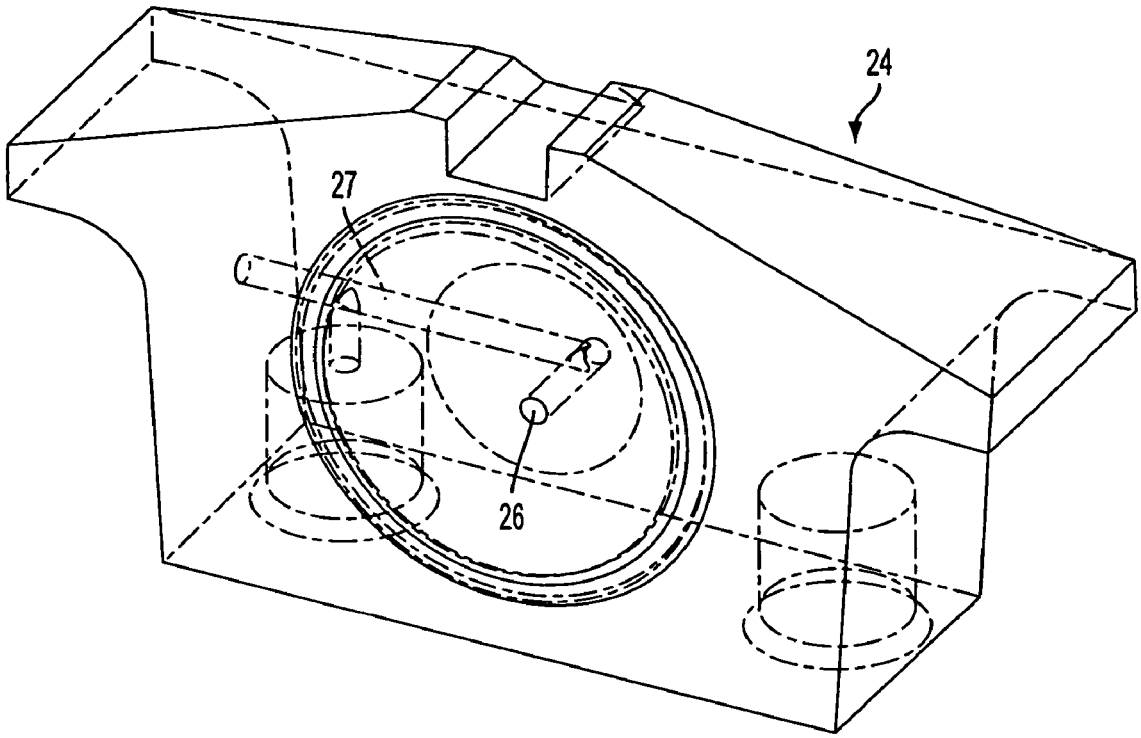
FIG. 7 is a line drawing of the retaining device of FIG. 6 showing the internal duct work and passages therein.
Figure 8:
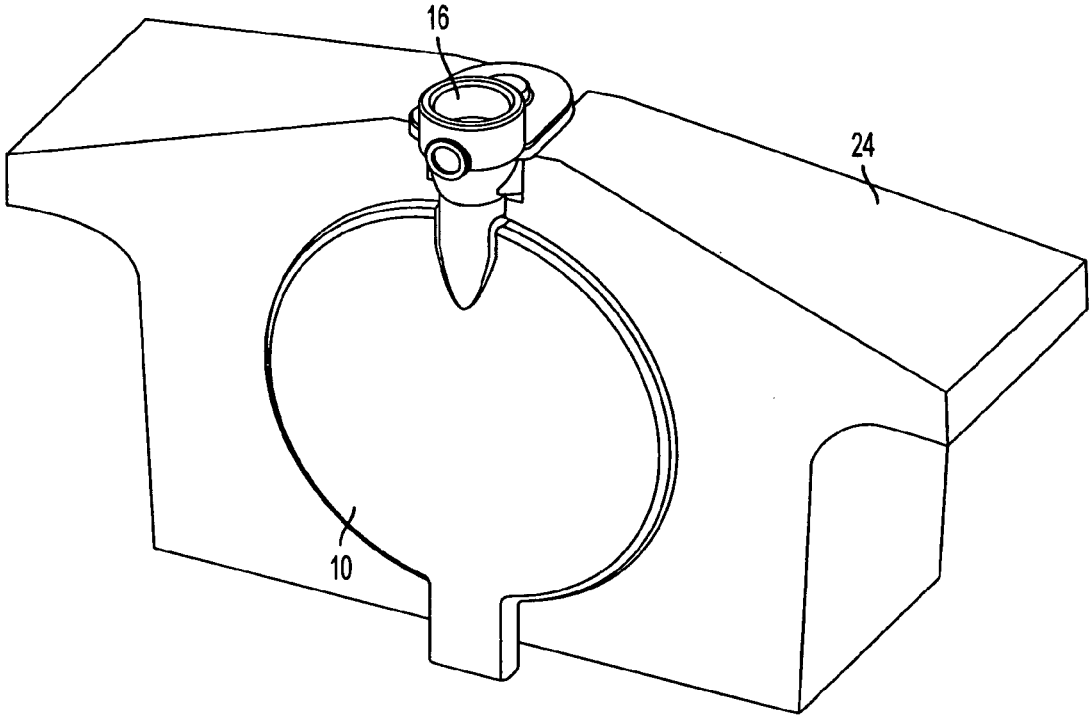
FIG. 8 is an elevated perspective view of the reservoir of FIG. 1 retained in the retaining device of FIG. 6.

To aid the transport and orientation of the non-standard reservoirs 10 to be filled and sealed, a container retaining device 24 is used, see FIGS. 6, 7 and 8. The retaining device 24 can be used separately or combined with other retaining devices in a magazine, not shown, or the retaining device 24 may have interlocking elements thereon, also not shown, to allow the retaining device 24 to mate with others to form a magazine. The magazine may resemble a slide tray for a 35 mm projector, and may be round, like a carousel, rectangular, square or any other shape desired. When combined, the reservoir retaining device 24 will allow a dense packing of the reservoirs 10 for the entire sequence of unit operations that occur along a fill and seal line.

Figure 9:
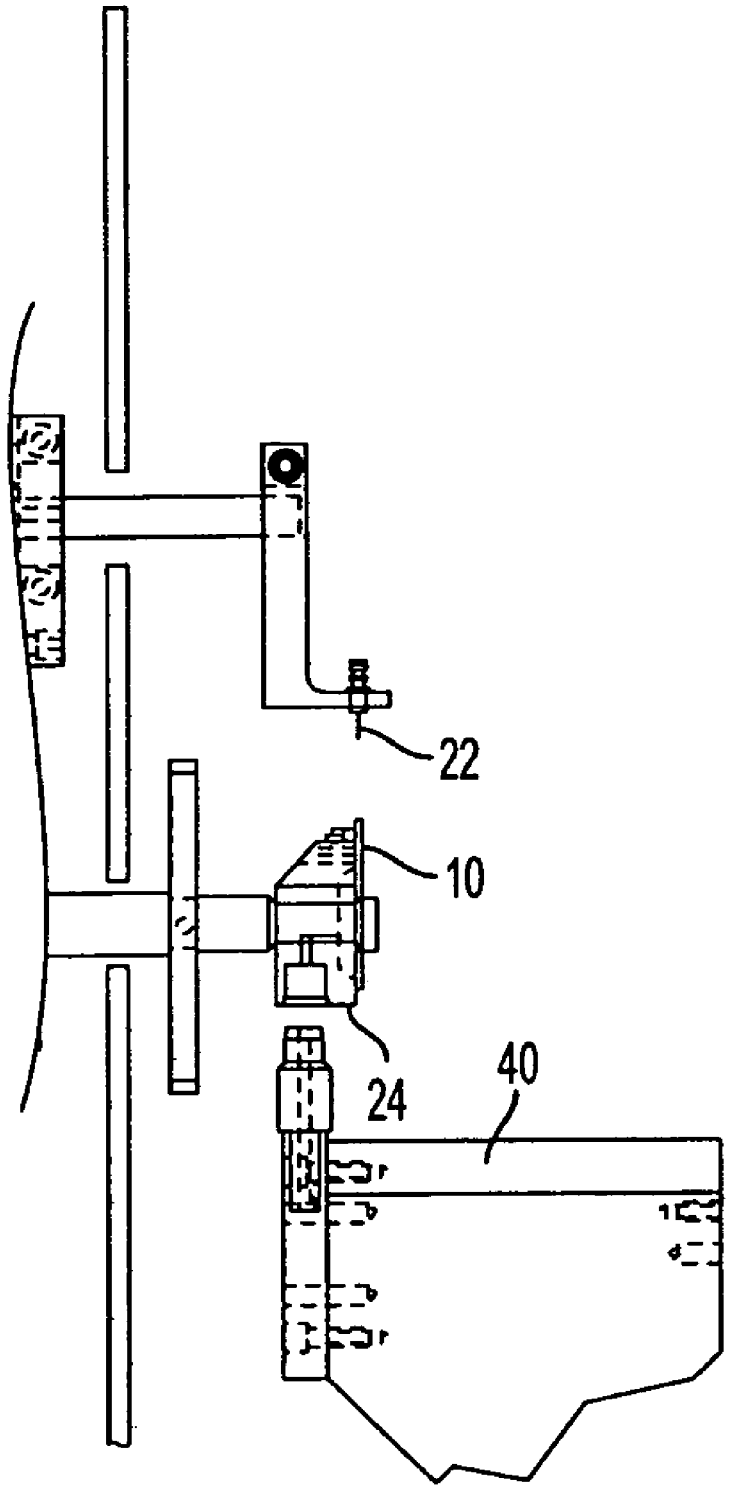
FIG. 9 is a side perspective view of certain filling mechanisms for lifting and dispensing of fluid into the reservoir and retaining device of FIG. 8.

The reservoirs 10 are held securely within the retaining device 24 with their fluid receiving openings 16 oriented to ensure positive location for the fluid dispensing apparatus, preferably automated, see FIG. 9, and to provide support for any physical contact necessary for the sealing of the reservoir 10 after filling. The retaining device 24 may also have teeth along one or more edges, not shown, to provide a means for proper location and orientation of each reservoir under the fluid dispensing apparatus. Alternatively the fluid dispensing apparatus could index with respect to retaining device 24 and the fluid receiving opening 16. Another advantage of retaining the container 10 is that the retainer 24 and container 1I may be raised to the filling nozzle 22, see FIG. 9, rather than the standard method of lowering the fill nozzle, and associated equipment down to the container opening 16. Raising the container 10 to the nozzle 22 minimizes the chances and opportunities for particulate contaminants to become dislodged on overhanging equipment and end up inside the container.

A magazine, especially one in which the retaining device and magazine or integral, provides a preferred means to present irregular, non-standard containers in a traditional fashion to conventional filling technology, especially when those containers take a different form than the reservoirs 10 shown. A magazine can achieve a number of specific functions to accomplish this, such as: facilitating transport between filling unit operations; facilitating transport of the reservoirs from the fabrication area to the filling area, including those cases where the parts would be shipped to other manufacturing facilities; positioning and holding the retaining device for filling; providing an optical pathway for drug visualization including the means to back-light and thoroughly inspect through proper lighting; using lights, light pipes, mirrors, etc. for full reservoir inspection; and providing adequate space between reservoirs to ensure full expansion of the flexible sides to provide for specific fill volumes. Preferably the retaining devices 24 and magazines, if utilized, are also sterilizable and reusable. When used as the shipping container a magazines also provides a means to ensure that the parts arrive undamaged and that they retain their orientation. Of course, the retaining device 24 itself, whether or not combined into a magazine, can individually also perform these various functions if so desired.

By utilizing a reservoir retaining device 24 the aseptic filling and sealing process can preferably be accomplished in the manner described below. Of course, there may be alternative processes, such as in a process that is automated or only partially automated to mention only two.

Figure 3:
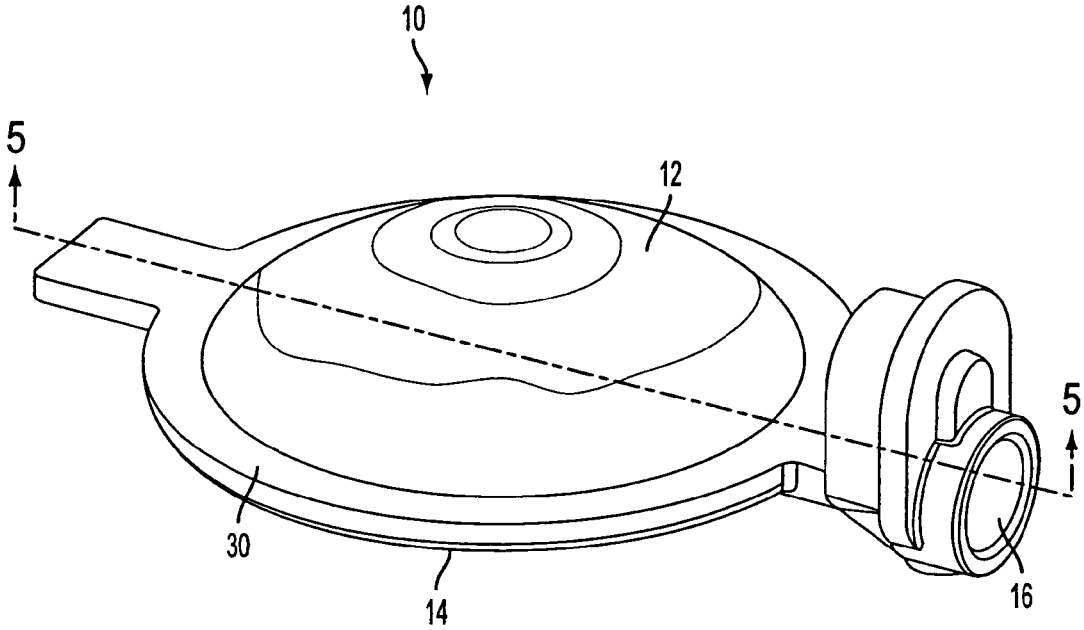
FIG. 3 is a side, edge on view of the reservoir of FIG. 1 in an expanded, non-relaxed condition.
Figure 4:
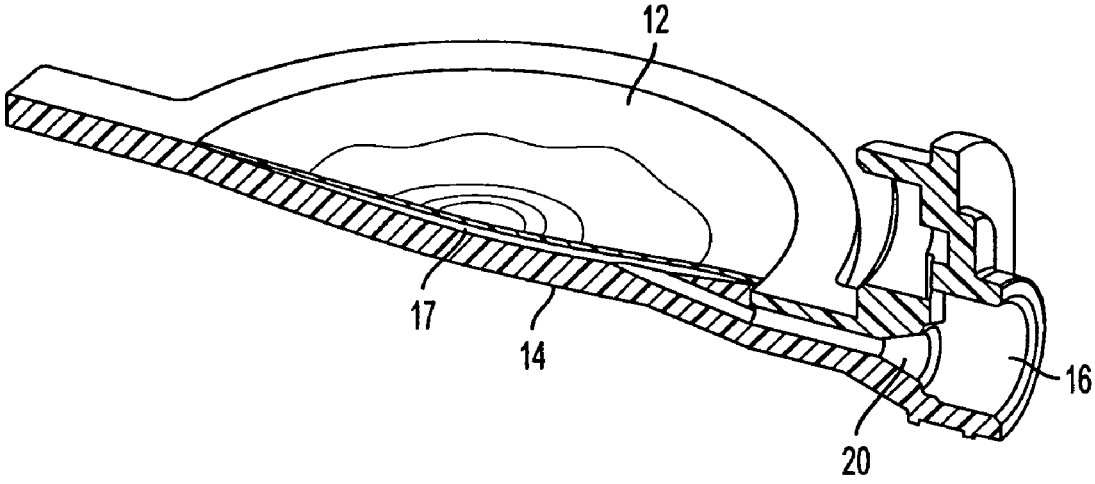
FIG. 4 is a cross sectional view of the reservoir of FIG. 2.
Figure 5:
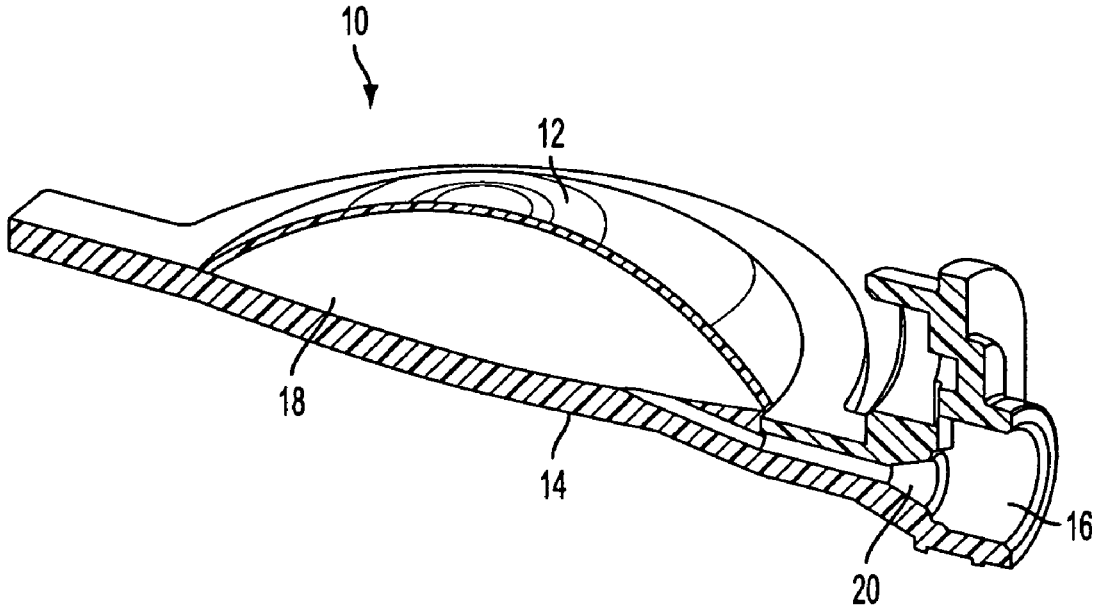
FIG. 5 is a cross sectional view of the reservoir of FIG. 3.

Once the reservoirs 10 have been loaded and properly oriented within the reservoir retaining device 24 the interior volume of reservoir 10 is expanded from its relaxed state volume 17 to its non-relaxed state volume 18, see FIGS. 4 and 5. The non-relaxed state volume 18 of reservoir 10 is preferably greater than the fluid fill volume which is the interior volume of the reservoir 10 when the reservoir 10 has been filled with fluid to its desired and predetermined volume. If a container, different from container 10 is utilized, the non-relaxed state interior volume may or may not be greater than the fill volume. The expansion of the relaxed state interior volume 17 is accomplished by manipulating the at least one flexible component 12 of container/reservoir 10, which in the embodiments shown is flexible film 12. Flexible film 12 is preferably moved, or expanded, from its relaxed state 17, shown in FIG. 4 by the application of a vacuum through port 26 of retaining device 24. O-ring 28 creates a seal with the edge surface 30 of container 10. The vacuum created within the retaining device hollow space 31 expands flexible component 12 to the container non-relaxed interior volume 18, FIGS. 3 and 5.

Flexible component 12 may also be expanded to achieve the fullest interior volume by other means, such as by inflating the interior with a gas through the fluid receiving opening or other opening if the container has one. The gas, such as an inert gas, for example, can be pushed into the reservoir in any number of ways such as a seal against the reservoir inlet, a jet of air from just above the fluid receiving opening would provide sufficient pressure to inflate the reservoir without making contact. It is preferred that a gas jet or nozzle, with its opening just above the fluid receiving opening, would put out a short puff as the reservoir passes by. This jet of gas will be of sufficient duration to expand the sides of the reservoir for filling. The flexible component of the reservoir will generally maintain its shape while the reservoir is empty, since the container is supported while being retained. The use of air, or other gases, generally requires that the gas be filtered to remove particulate contaminants, especially when an aseptic environment must be maintained.

By expanding or opening the interior volume to its fully open, or non-relaxed state, air within the interior volume is allowed to escape through opening 16 during filling. In addition, the opening can be made smaller, and hence, the device in which this is to be housed can be made smaller. Another advantage is that many bioactive fluids contain substances, like insulin for example, which are damaged by shear forces that can be encountered during the filling process. By opening the interior volume to its non-relaxed state lower fill pressures can be used resulting in reduced shear of the bioactive composition. Lastly, by utilizing slower fill pressures, air or gas bubbles will not be introduced into the fluid as it is being dispensed into the container.

After the flexible component 12, or components, has been expanded the empty container 10 can be tare weighed. The expanded container is then raised to a traditional filling dip tube, the dispensing tip of which passes through the fluid receiving opening 16 and the interior volume is filled to a predetermined level range using traditional time based fill control. The weight can also be checked to verify proper fill volume. The filled container 10 is then placed within an environment capable of enveloping both the fluid containing internal volume and at least the external surface of the flexible component with an area of pressure less than the ambient air pressure, such as a vacuum chamber. The air within the vacuum chamber is evacuated to a predetermined pressure range and in a preferred embodiment, a stopper 32 is partially inserted in the fluid receiving opening 16. The stopper 32 may contain a small side vent, like a Vacutainer® stopper, or preferably be solid. Alternatively another sealing method may be employed not using a 'stopper'. Since the air is removed from both the interior and exterior of the container 10 no movement of the meniscus within the interior volume occurs due to the balanced pressure. The reduction of pressure does, however, drive out much of the balance of the non-condensable and dissolved gases so care needs to be exercised that the pressure reduction does not cause the fluid within the container 10 to boil. By setting the predetermined pressure range to equal or exceed the vapor pressure of the fluid, boiling should not occur. It is also preferable that the rate at which the pressure is reduced does not to exceed the rate at which evacuated air can escape the interior of the container through the opening 16 otherwise the fluid will be entrained and expelled by the expanding air. Once the predetermined pressure range has been achieved the stopper 32, or other sealing means is secured and the container 10 is released from retainer 24.

After sealing the container 10 the environment of reduced pressure is released and ambient air pressure allowed to return. Since the air has been evacuated from the internal volume of the container, and if the fluid fill volume was less than the total interior volume 18, then the flexible component 12 will tend to flex inward and a third, fluid fill volume will be achieved. This third volume will generally, but not necessarily, be less than the non-relaxed state volume 18, and greater than, equal to, or in some instances, less than the relaxed state volume 17 of the container 10.

In certain situations is may be necessary to control the headspace by additional or alternate methods, such as for example by the manipulation of the meniscus. The reduced pressure environment also allows for the manipulation of the flexible component 12 to raise or lower the level of the meniscus so that the headspace volume within the interior comes within a predetermined acceptable range. After the meniscus has been manipulated to within the acceptable, predetermined range the stopper is driven home to seal the reservoir. Once removed from the vacuum chamber, the apparent headspace collapses at atmospheric pressure and the minute remaining headspace, if any, will generally dissolve into the drug solution. The stopper may also be further secured in the port by staking, insertion of a plug that is welded, press fit, glued or by swaging. Once filled, labeling and final packaging occur as is traditionally done.

The inventive methods will next be described as a manual aseptic fill and seal procedure. Protrusion 11 of non-standard container 10, which in the embodiment shown is a reservoir for a small microinfuser device, is pushed into the protrusion receiving guide 25 of retaining device 24. Guide 25 serves to support and help retain reservoir 10. Guide 25 also serves to orient reservoir flexible component 12 facing the hollowed out portion 31 of retaining device 24 and the O-ring 28 in contact with the edge surface 30 of the rigid plastic base 14 to which the flexible film 12 is non-releasably attached or affixed.

Retaining device 24 is placed on a lift mechanism 40 which mated with the underside of retaining device 24, not shown, and which also contains gas passages therein which in turn mate with internal gas passages 27 of retainer device 14. Gas passages terminate at port 26. A vacuum source, in fluid communication with the lifting mechanism 40 and retaining device 24, is activated causing flexible film 12 to be pulled into the hollow space 31 and thereby expanding the interior volume of reservoir 10 from its collapsed, relaxed state to an expanded non-relaxed, or stretched state. Lift mechanism 40 raises retaining device 24 and reservoir 10 retained therein up to a fluid dispensing nozzle or needle 41 until the fluid dispensing needle 41 is within fluid receiving opening 16. Conical structure 20 acts as a guide for dispensing needle 41 to assure proper positioning for filling. Fluid dispensing needle 41 dispenses a predetermined amount of fluid into the interior volume of reservoir 10 as is known in the art.

Lifting mechanism 40 then lowers the retaining device 24 and retained reservoir 10 away from fluid dispensing needle 41 after the fluid has been dispensed therein. Lift mechanism 40 then positions the retaining device 24 and fluid filled reservoir 10 into an vacuum chamber to create an environment of air pressure less than that of the ambient air pressure on both the external surfaces and internal surfaces of the reservoir 10 and fluid contained therein. By manipulating the air pressure within gas passages 27 flexible component 12 is flexed to raise or lower the fluid meniscus and the associated headspace volume to a predetermined range of acceptable limits. Once the meniscus level has been attained the fluid receiving opening is stoppered and sealed.

As will be apparent to one skilled in this art, the retaining device 24 for releasably retaining the container 10, can be modified or design to releasable retain the device in which the container 10 itself is housed, such as an assembled or partially assembled microinfuser for example. Such a method for then include the releasable retention of the device containing the fluid reservoir or container 10, and allow for the dispensing of the fluid into the container 10 while the container 10 itself was inside the assembled, or partially assembled device.

We claim:

1. A method for filling and sealing a container comprising at least one fluid receiving opening, at least one flexible component, at least one rigid component, a relaxed state interior volume, and a non-relaxed state interior volume, wherein said non-relaxed state volume is greater than or equal to said relaxed state volume, said method comprising:

forming a pressurizable chamber by releasably retaining said at least one rigid component of said container, wherein at least a portion of said chamber is formed by said at least one rigid component and said chamber allows movement of said at least one flexible component within said chamber;

positioning said retained container in a position to receive a fluid to be contained therein through said at least one fluid receiving opening;

expanding the relaxed state interior volume of said container to said non-relaxed state interior volume by application of a predetermined pressure range within said chamber, wherein said pre-determine pressure range is less than ambient atmospheric pressure;

subjecting the interior volume of said container to a predetermined pressure range wherein said pressure range is greater than or equal to the vapor pressure of said fluid within said container and less than ambient atmospheric pressure;

dispensing a fluid into said non-relaxed interior volume of said container;

sealing said at least one fluid receiving opening;

increasing the pressure of said chamber to ambient atmospheric pressure; and releasing said container from said releasably retained position.

2. The method of claim 1 wherein the steps are performed under aseptic conditions.

3. The method of claim 1 wherein the steps are performed in the order recited.

4. The method of claim 1 wherein two or more steps are performed essentially simultaneously.

5. The method of claim 1 wherein the expansion of the relaxed state interior volume of said container to said non-relaxed state interior volume flexes said at least one flexible component.

6. The method of claim 1 further comprising injecting a gas into said container interior volume.

7. The method of claim 6 wherein said gas is an inert gas.

8. The method of claim 1 wherein the dispensing and sealing steps are performed at separate physical locations.

9. The method of claim 1 further comprising inserting a fluid dispensing nozzle into said at least one fluid receiving opening prior to dispensing said fluid.

10. The method of claim 1 further comprising the manipulation of the fluid meniscus formed within said interior volume to increase or reduce the headspace to a predetermined range by a physical movement of said flexible component.

11. The method of claim 10 wherein the physical movement of said at least one flexible component is performed by expanding or contracting said at least one flexible component.

12. The method of claim 1 wherein said at least one component internal surface is hydrophilic.

13. The method of claim 1 wherein said at least one component internal surface is hydrophobic.

14. The method of claim 1 wherein said container at least one flexible component comprises less than two-thirds of the total structural components of said container.

15. The method of claim 1 wherein said container at least one flexible component comprises more than two-thirds of the total structural components of said container.

16. The method of claim 1 wherein said at least one fluid receiving opening further comprises an inverted hollow conical structure positioned therein such that the narrowest portion of said hollow conical structure opens to the interior volume of said container.

17. The method of claim 16 wherein said at least one fluid receiving opening and said hollow conical structure are contiguous.

18. The method of claim 1 wherein said expanding step is performed prior to said subjecting the interior volume of said container to a predetermined pressure range step.

19. The method of claim 1 wherein said subjecting the interior volume of said container to a predetermined pressure range step is performed prior to said expanding step.

* * * * *